US006524138B1

(12) United States Patent
Li et al.

(10) Patent No.: US 6,524,138 B1
(45) Date of Patent: Feb. 25, 2003

(54) AUDIO JACK CONNECTOR HAVING MEANS FOR PREVENTING ABRASION OF A FRONT FACE THEREOF BY A MATING PLUG CONNECTOR

(75) Inventors: XiaoLi Li, Kunsan (CN); GuangXing Shi, Kunsan (CN); Zhiqiang Wang, Kunsan (CN); Weiya Cheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/191,101

(22) Filed: Jul. 8, 2002

(30) Foreign Application Priority Data

Apr. 30, 2002 (TW) ..... 91205996 U

(51) Int. Cl.[7] ..... H01R 17/18
(52) U.S. Cl. ..... 439/669; 439/948
(58) Field of Search ..... 439/669, 668, 439/948, 660; 200/51.1

(56) References Cited

U.S. PATENT DOCUMENTS 3,649,948 A * 3/1972 Porter ..... 439/195
4,659,167 A * 4/1987 Masuda ..... 439/668
4,937,404 A 6/1990 Kitagawa
6,220,899 B1 * 4/2001 Suzuki ..... 439/669
6,224,396 B1 * 5/2001 Chan et al. ..... 439/66
6,227,880 B1 * 5/2001 Zhu et al. ..... 439/607
6,270,380 B1 * 8/2001 Shichida et al. ..... 200/51.1

FOREIGN PATENT DOCUMENTS

JP 53-24981 3/1978

* cited by examiner

*Primary Examiner*—Lynn D. Feild
*Assistant Examiner*—Phuong KT Dinh
(74) *Attorney, Agent, or Firm*—Wei Te Chung

(57) ABSTRACT

A jack connector (1) is provided for receiving a mating plug (4). The jack connector includes an insulative housing having an upper wall (20), a rear wall (22) and a pair of side walls (23, 24). A receiving space (26) is defined together by the upper wall, the rear wall and the pair of side walls. A rear corner (28) is formed between the upper wall and the rear wall. The rear corner has an inclined face (280) facing the receiving space. The inclined face is used for abutting against an oblique face (402) of a cone end (40) of the mating plug, thereby preventing the plug from moving too inwardly into the receiving space when the plug is inserted into the receiving space. Thus, an engagement of a front face of the housing of the jack connector with the plug is prevented when the plug mates with the jack connector. Accordingly, an abrasion/scrape of the front face of the housing of the jack connector by the plug is prevented.

5 Claims, 5 Drawing Sheets

AUDIO JACK CONNECTOR HAVING MEANS FOR PREVENTING ABRASION OF A FRONT FACE THEREOF BY A MATING PLUG CONNECTOR

BACKGROUND OF THE INVENTION

1. Field of the Invention

The present invention generally relates to a jack connector, and more particularly to a jack connector having a housing defining an inclined face for intimately engaging with an oblique front face of a plug connector, thereby preventing a front face of the jack connector from being abraded/scraped by the plug connector.

2. Description of Related Art

Jack connectors are widely used in various applications such as telecommunications equipments, computers and the like. Conventional jacks include an insulative housing defining an interior space for receiving a mating plug and a plurality of conductive terminals extending into the interior space. When the mating plug is inserted into the interior space of the jack connector, an electrical path is established between the mating plug and the conductive terminals of the jack connector for transmitting signals therebetween. Examples of such conventional jack connectors are disclosed in Japanese Utility Model Publication No. 53-24891 and U.S. Pat. No. 4,937,404.

Referring to FIG. 4, the jack connector 9 disclosed in Japanese Utility Model Publication No, 53-24981 mates with a plug 8. The jack connector 9 includes an insulative housing 90 having a front wall 91 and a mating portion 92 protruding from the front wall 91. An interior space 93 is defined in the housing 90. A mating opening 94 is defined in the mating portion 92 and communicates with the interior space 93. When the plug 8 is inserted into the mating opening 94, the plug 8 mates with a terminal 95 of the jack connector 9 for achieving an electrical connection between the jack connector 9 and the plug 8. In such design, when the plug 8 is fully inserted into the jack 9, an engaging portion 80 of the plug 8 is in abutment with a mating face 920 of the mating portion 92. Such an abutment causes abrasion of the mating face 920 of the jack connector 9 by the plug 8. The abrasion adverse affects the appearance of the jack connector 9.

To solve above problems, U.S. Pat. No. 4,937,404 discloses another conventional jack connector, as shown in FIG. 5. The jack connector 7 includes an insulative housing 70 defining an interior space 71 for receiving a plug 6 and a substantially planar inner wall 710 at a rear end (not labeled) of the housing 70. When the plug 6 is inserted into the interior space 71 of the housing 70, a front face 60 of the plug 6 abuts against the inner wall 710 for preventing the plug 6 from moving too inwardly. Such a design can avoid an engagement between a connecting portion 62 of the plug 6 and a front face 72 of the housing 70 of the jack connector 7. Thus, the abrasion of the front face 72 of the housing 70 by the plug 6 is avoided. However, since accuracy of the planarity of the front face 60 and its verticality relative to a longitudinal axis of the plug 6 is difficult to control during the manufacturing of the plug, a correct engagement between the front face 60 of the plug 60 and the inner wall 710 of the housing 70 is difficult to attain. This in turn affects the quality of the electrical connection between the plug and the jack connector.

Hence, an improved jack connector is desired to overcome the above mentioned disadvantages of prior art.

SUMMARY OF THE INVENTION

Accordingly, an object of the present invention is to provide a jack connector which can reliably engage with a mating plug, and a front face of the jack connector is not scraped by the plug when the plug is inserted into the jack connector to electrically connect therewith.

To achieve the above object, a jack connector in accordance with the present invention includes an insulative housing having an upper wall, a pair of side walls and a real wall. A receiving space is defined together by the upper wall, the pair of side walls and the rear wall. The upper wall has a rear corner portion having an inclined face facing the receiving space. The inclined face intimately engages with an oblique face of a front cone end of the mating plug, thereby preventing the mating plug from moving too inwardly into the receiving space. Thus, an engagement between the plug and a front face of the jack connector is prevented when the jack connector and the plug are electrically connected together. The engagement between the oblique face of the front cone end of the plug and the inclined face of the rear corner portion of the jack connector also helps achieving a good quality of electrical connection between the plug and jack connector when they are mated together.

Other objects, advantages and novel features of the invention will become more apparent from the following detailed description when taken in conjunction with the accompanying drawings.

DETAILED DESCRIPTION OF THE PREFERRED EMBODIMENT

Figure 1:
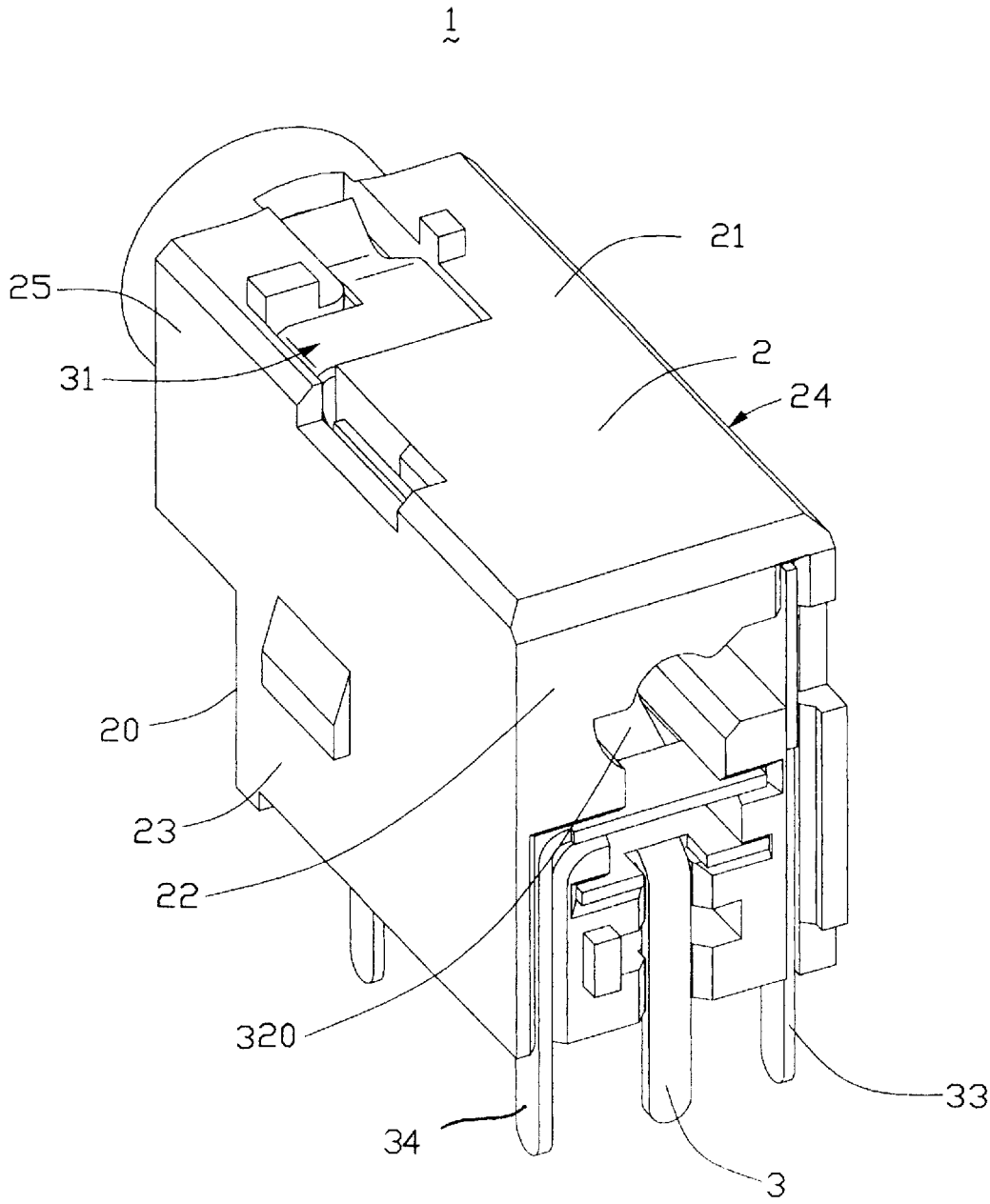
FIG. 1 is a perspective view of a jack connector in accordance with the present invention, from a rear aspect.
Figure 2:
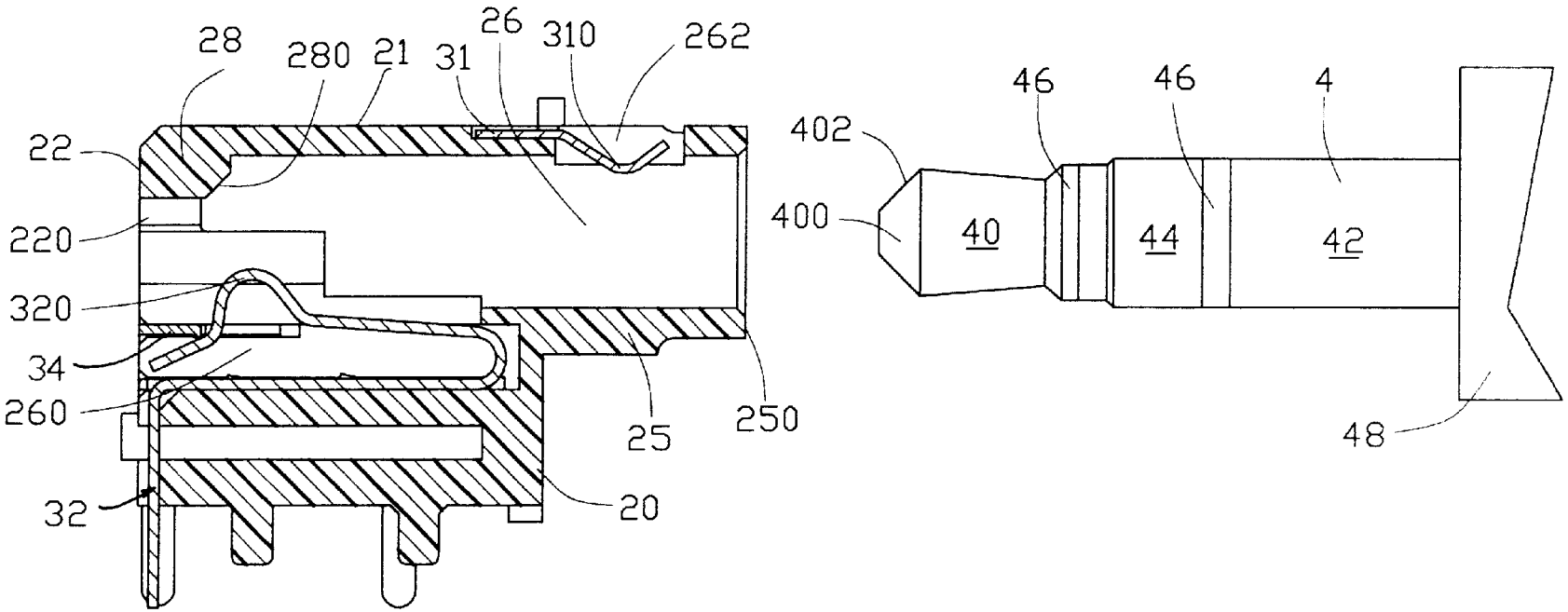
FIG. 2 is a cross-sectional view of the jack connector of FIG. 1 and a side view of a complementary plug to mate with the jack connector.

Referring to FIG. 1 and FIG. 2, a jack connector in accordance with the present invention, generally designated with reference numeral 1, comprises an insulative housing 2 and a plurality of conductive terminals 3 mounted to the housing 2. The insulative housing 2 has a front wall 20, an upper wall 21, a rear wall 22 opposite to the front wall 20 and a pair of side walls 23 and 24. A mating portion 25 protrudes from the front wall 20. A receiving space 26 is defined together by the upper wall 21, the pair of side walls 23, 24 and the rear wall 22 for insertion therein a mating plug 4. An opening (not labeled) is defined in the rear wall 22 and for insertion of a terminal (described in details later) and in communication with the receiving space.

The mating plug 4, as shown in FIG. 2, is used for mating with the jack connector 1 of the present invention for providing an electrical connection between two electrical devices, such as a speaker and a computer. The plug 4 comprises a tip terminal portion 40 at a front end thereof, a ground terminal portion 42 at a rear end thereof and an intermediate terminal portion 44 between the tip and ground terminal portions 40, 42. The terminal portions 40, 42, 44 are electrically separated from each other by dielectric insulators 46. The ground terminal portion 42 connects with a connecting portion 48. Since the structure of the plug 4 is well known by those skilled in the art, detailed description thereof is omitted here. However, it should be noted that the tip terminal portion 40 has a cone end 400 having an oblique face 402. The oblique face 402 is inclined an angle of 45 degrees relative to a longitudinal axis of the plug 4.

Referring particularly to FIG. 2, a rear opening 220 is defined in the rear wall 22 and communicates with the receiving space 26. A rear corner 28 is formed between the upper and rear walls 21, 22 of the insulative housing 2. The rear corner 28 forms an inclined face 280 facing the receiving space 26. The inclined face 280 is inclined an angle corresponding to that of the oblique face 402 so that when the plug 4 is inserted into the jack connector 1, the oblique face 402 intimately engages with the inclined face 280. The inclined face 280 is inclined 45 degrees relative to a longitudinal axis of the jack connector 1.

A plurality of slots 260 is defined in the rear wall 22 of the housing 2 and communicates with the receiving space 26. A groove 262 is defined in an upper part of the mating portion 25 of the housing 2 and communicates with the receiving space 26. The conductive terminals 3 of the jack connector 1 generally include a grounding terminal 31, a movable (switch) terminal 32, a stationary (switch) terminal 34 and a number of signal terminals 33. The movable (switch) terminal 32 and the signal terminals 33 are received in the slots 260, respectively, and each have a portion extending into the receiving space 26. The grounding terminal 31 is retained into the groove 262 defined in the mating portion 25 and has a contact portion 310 which projects into the receiving space 26 for contacting the mating plug 4, as described hereinafter.

Figure 3:
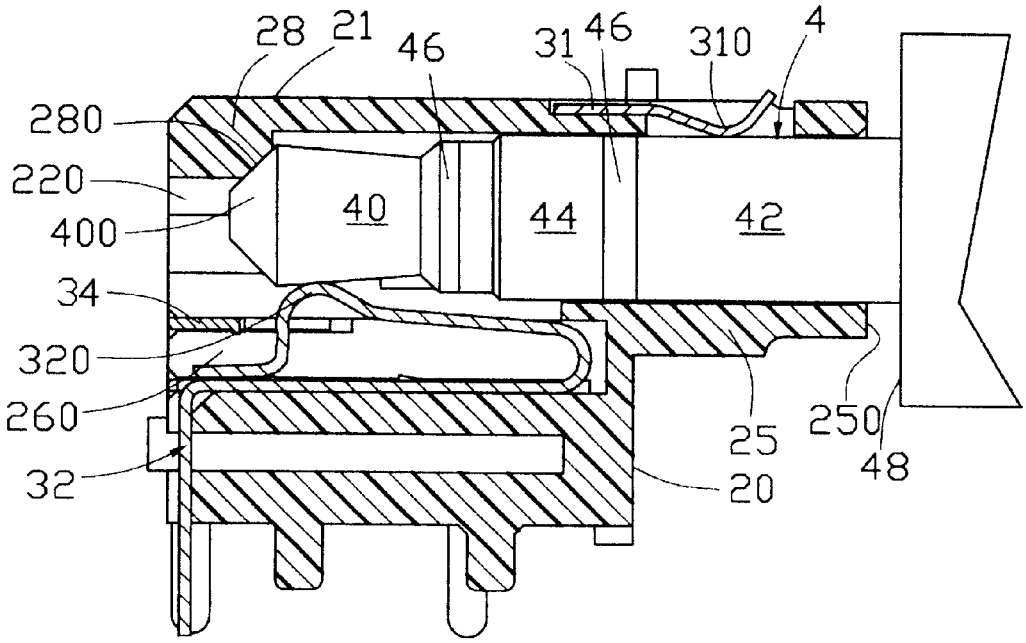
FIG. 3 is a view similar to FIG. 2 with the complementary plug completely mating with the jack connector.
Figure 4:
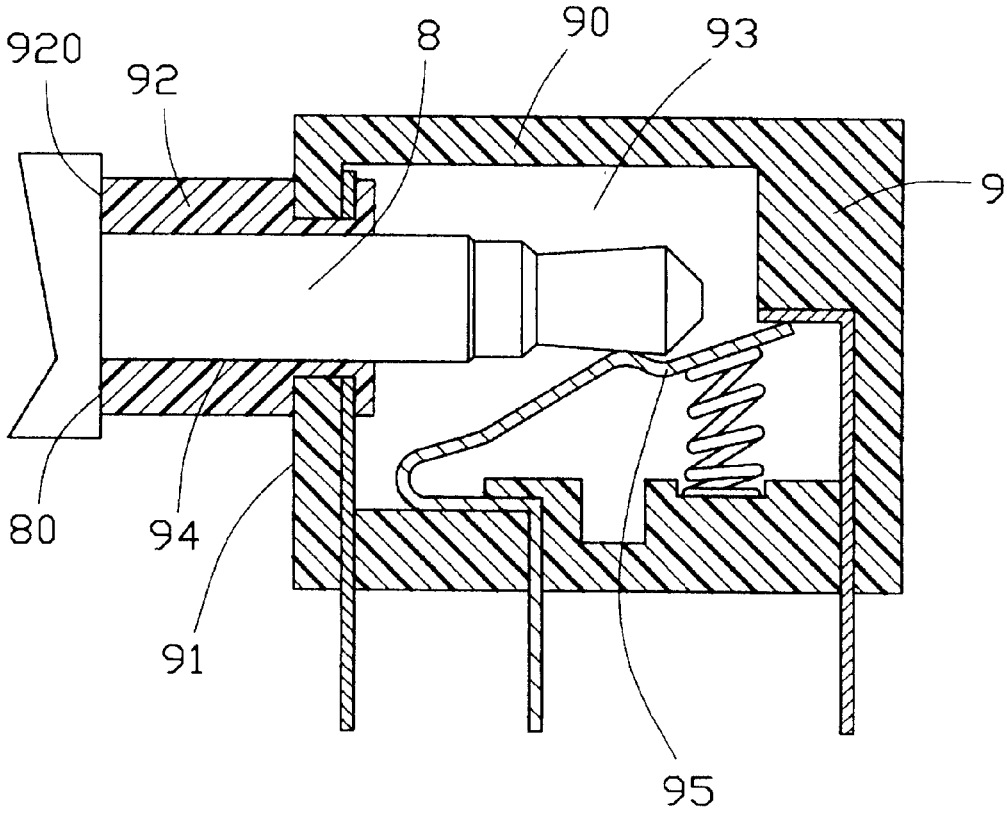
FIG. 4 (PRIOR ART)
FIG. 4 is a cross-sectional view of an conventional jack connector mating with a plug.
Figure 5:
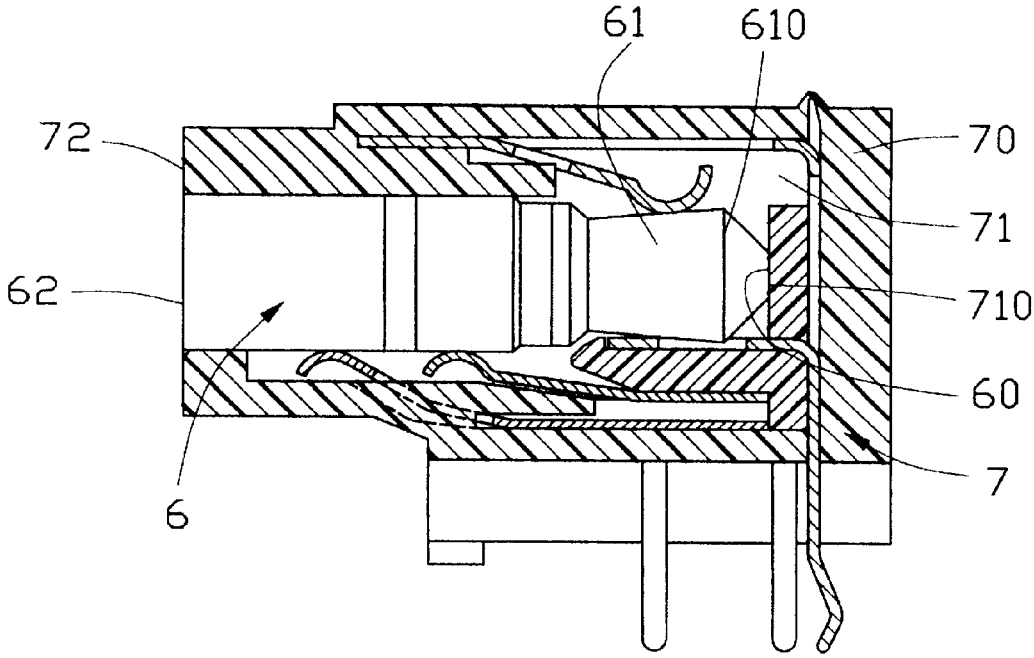
FIG. 5 (PRIOR ART)
FIG. 5 is a cross-sectional view of another conventional jack connector mating with a plug.

As stated above, the mating plug 4 is inserted into the jack connector 2 from a front face 250 of the mating portion 25. When the mating plug 4 is fully inserted into the jack connector 1, the oblique face 402 of the cone end 400 is in intimate engagement with the inclined face 280 of the rear corner 28. Referring particularly to FIG. 3, the tip terminal portion 40 engages with a contact portion 320 of the movable terminal 32 thus resulting in the terminal 32 being disengage from the terminal 34 with thereof the distal end engaged with another its own portion for increasing the normal force thereof, the ground terminal portion 42 of the mating plug 4 engages with the contact portion 310 of the grounding terminal 31.

The advantages of the present invention over the prior art is that the jack connector 1 has the rear corner 28 which has the inclined face 280 for abutting with the mating plug 4. This abutment can increases the stability of the engagement between the jack connector 1 and the mating plug 4. At the same time, this abutment prevents the mating plug 4 from moving too inwardly into in the receiving space 26, and, thus, prevents the connecting portion 48 of the plug 4 from engaging with the front face 250 (Shown in FIG. 3) of the jack 1, thereby, avoiding an abrasion/scrape of the front face 250 of jack connector 1 by the connecting portion 48 of the plug 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A jack connector for receiving a mating plug, comprising:

an insulative housing having an upper wall, a pair of side walls and a rear wall, a receiving space defined together by the upper wall, the pair of side walls and the rear wall, a rear corner being formed between the upper wall and the rear wall, the rear corner having an inclined face facing the receiving space and adapted for abutting against a cone end of the mating plug when the mating plug is inserted into the receiving space so that an abrasion of a front face of the housing of the jack connector by the plug is prevented; and a plurality of conductive terminals separately retained in the insulative housing, each having a portion extending into the receiving space adapted for electrically connecting with the mating plug, wherein a rear opening is defined in the rear wall of the insulative housing and communicates with the receiving space, wherein the inclined face is inclined substantially 45 degrees relative to a longitudinal axis of the insulative housing.

2. The jack connector as described in claim 1, wherein the insulative housing has a mating portion extending forwardly from a front wall thereof, a groove is defined in the mating portion and communicates with the receiving space.

3. The jack connector as described in claim 2, wherein the conductive terminals include a grounding terminal, a movable terminal and a number of signal terminals.

4. The jack connector as described in claim 3, wherein the grounding terminal is received into the groove of the mating portion.

5. An electrical connector assembly comprising:

a jack connector comprising an insulative housing and a plurality of conductive terminals, the housing having an upper wall, a pair of side walls and a rear wall, a receiving space defined together by the upper wall, the pair of side wall and the rear wall, a rear corner being formed between the upper wall and the rear wall, the rear corner having an inclined face facing the receiving space, the conductive terminals separately retained in the insulative housing and having a portion extending into the receiving space; and a mating plug comprising a cone end at a front end thereof, the cone end having an oblique face, the oblique face of the mating plug abutting against the inclined face of the rear corner of the jack connector when the mating plug is fully inserted into the jack connector, wherein the oblique face of the cone end of the mating plug is inclined an angle 45 degrees relative to a longitudinal axis of the plug, the inclined face of the rear corner of the jack connector is inclined an angle corresponding to that of the oblique face.

* * * * *